United States Patent [19]

Jones

[11] Patent Number: 4,964,398

[45] Date of Patent: Oct. 23, 1990

[54] SHAMPOO OR MASSAGE DEVICE

[76] Inventor: Letha L. Jones, 830 W. Princess Dr., Corpus Christi, Tex. 78410

[21] Appl. No.: 182,390

[22] Filed: Apr. 18, 1988

[51] Int. Cl.[5] ..... A61H 7/00

[52] U.S. Cl. ..... 128/51; 128/56; 128/52; 15/22.1

[58] Field of Search ..... 128/51, 56, 52; 15/224, 15/33, 32, 81, 49 RB, 22 R

[56] References Cited

U.S. PATENT DOCUMENTS

| | | | |
|---|---|---|---|
| 729,187 | 5/1903 | King | 15/22 |
| 873,123 | 12/1907 | Gardu | 128/49 |
| 1,608,859 | 11/1926 | Pinkston | 128/56 |
| 2,869,158 | 1/1959 | Sivells | 15/22 |
| 3,472,490 | 10/1969 | Fitzhugh | 15/22 |
| 3,511,229 | 8/1970 | Romo | 15/22 |
| 3,517,235 | 8/1970 | Flowers et al. | 15/22 |
| 3,992,744 | 11/1976 | Fassler | 15/22 |
| 4,162,675 | 7/1979 | Kawada | 128/56 |
| 4,203,431 | 5/1980 | Abura et al. | 128/56 |

*Primary Examiner*—Edgar S. Burr
*Assistant Examiner*—Lisa E. Malvaso
*Attorney, Agent, or Firm*—G. Turner Moller

[57] ABSTRACT

A shampoo or massage device includes a pistol grip handle having therein rechargeable batteries. A housing perpendicular to the handle includes partition walls providing a plurality of axially spaced cavities or compartments in which a dc motor, a gear reduction unit and a rotary-to-reciprocating conversion unit are mounted. The cavities housing the batteries, motor and gear reduction unit are sealed against the entry of moisture. A body engaging assembly or brush is mounted on the output of the rotary-to-reciprocating conversion unit and carries a plurality of fingers generally parallel to the housing axis.

8 Claims, 2 Drawing Sheets

SHAMPOO OR MASSAGE DEVICE

This invention relates to a hand held battery powered shampoo or massage device that produces a reciprocating stroke of a brush or body engaging member.

This invention comprises a shampoo or massage device and is the culmination of design efforts commencing with U.S. Pat. No. 2,869,158. More particularly, this invention relates to a portable battery powered shampoo or massage device for either home or professional use. Scrubbing the hair and scalp during a shampoo has remained a manual operation because of the danger in using an electrically driven device powered by 110 volt ac in a wet environment. The development of high capacity, low voltage rechargeable dc batteries now allows electrically driven appliances intended to be used in and around water without fear of electric shock as shown in U.S. Pat. No. 3,511,229. It is this class of device to which this invention most nearly relates.

Other disclosures of interest are found in U.S. Pat. Nos. 729,187; 3,472,490; 3,517,235; and 3,992,744.

This invention comprises a portable hair shampoo or massage device in a housing of generally pistol shape. The handle or pistol grip houses a plurality of rechargeable batteries connected through a switch to a dc motor carried in one of a plurality of axially aligned compartments above the pistol type handle. The dc motor drives a gear reducer located in a second of the axially aligned compartments. The gear reducer in turn drives a rotary-to-reciprocating motion conversion device located in a third of the axially aligned compartments. Suitable sealing means between the second and third compartments and around the output shaft of the gear reducer effectively waterproofs the inside of the housing, leaving the third compartment unwaterproofed. A massage head or brush is detachably mounted on a shaft which oscillates or reciprocates in a direction transverse to an axis of the aligned compartments.

It is accordingly an object of this invention to provide a improved shampoo or massage device which is driven by a rechargeable dc motor and which is effectively waterproofed.

Other objects and advantages of this invention will become more fully apparent as this description proceeds, reference being made to the accompanying drawings and appended claims.

IN THE DRAWINGS

Figures 1, 2:
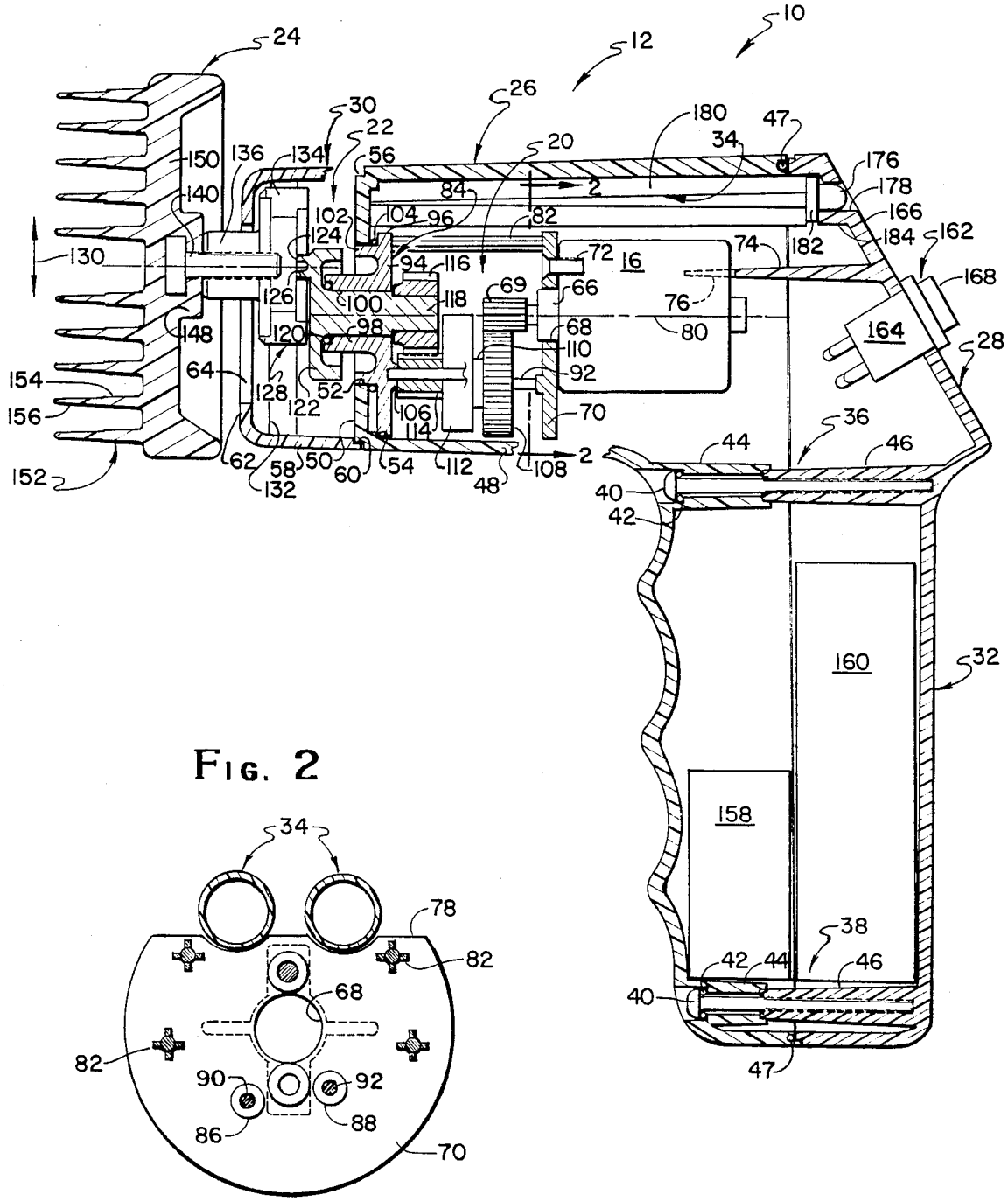
FIG. 1 is longitudinal cross-sectional view of the shampoo or massage device of this invention.
FIG. 2 is an enlarged transverse cross-sectional view of the device of FIG. 1, taken substantially along line 2—2 thereof as viewed in the direction indicated by the arrows, certain parts being omitted for clarity of illustration.
Figure 3:
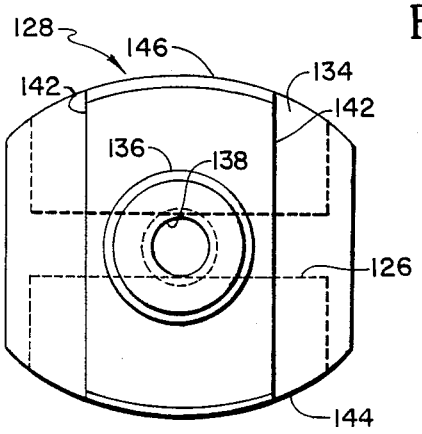
FIG. 3 is an enlarged end view of the eccentric which oscillates up and down and which carries the body engaging member.

Referring to FIGS. 1–3, there is disclosed a shampoo or massage device 10 of this invention comprising, as major components, a housing 12 of pistol shape, a dc motor 16 controlled and powered by an electrical circuit 18, a gear reducer 20 driven by the motor 16, a motion converter 22 which converts a rotating input into a reciprocating output and a shampoo or massage head 24 mounted on the end of the motion converter 22.

The housing 12 is of pistol shape and includes a main housing section 26 providing a first compartment for the motor 16 and a second compartment for the gear reducer 20. The housing also includes a housing cover 28 and an end cap 30 providing a third compartment for the motion converter 22. As is evident from FIG. 1, the main housing section 26 and cover 28 cooperate to provide a pistol grip handle 32 having the batteries therein. The main housing section 26 and housing cover 28 are releasably connected by four sets of screw-boss fastener assemblies 34, 36, 38. The assemblies 34, 36, 38 are substantially identical and comprise screws 40 extending through an O-ring seal 42 and a boss 44 into threaded engagement with an aligned boss 46. The screws 40 are of the self-tapping type and make their own threads in the passage provided by the boss 46. As will be apparent hereinafter, the upper set of fastener assemblies 34 has an additional function. An O-ring seal 47 extends around the junction between the main housing section 26 and the housing cover 28 to prevent water entry into the housing 12.

The main housing section 26 includes a generally cylindrical portion 48 extending perpendicularly from the pistol grip handle 32. The main housing section 26 is partially closed by an end wall 50 having an opening 52 therein. A shoulder 54 on the inside of the end wall provides an abutment as will be apparent hereinafter. The outer surface of the end wall 50 includes a rim 56 of reduced diameter receiving the end cap 30.

The end cap 30 comprises an extension of the cylindrical portion 48 of the housing 12. The end cap 30 comprises a peripheral wall 58 having a recess 60 which fits over the rim 56 of the end wall 50 and a front wall 62 providing an elongate vertical slot 64 therein as will be evident hereinafter. Suitable screw-boss fastener assemblies (not shown) are provided, out of the plane of the cross-section of FIG. 1, connecting the end cap 30 to the end wall 50 of the main housing section 26.

The motor 16 includes a central hub 66 extending through a central opening 68 of a first partition wall or rear gear plate 70. The first partition wall 70 effectively divides the main housing section 26 into a first compartment toward the handle 32 and a second compartment between the partition wall 70 and the end wall 50. The motor 16 is secured to the first partition wall 70 by a pair of threaded fasteners 72. The motor 16 is positioned inside the main housing section 26 but oddly is merely restrained instead of being rigidly secured thereto. The motor 16 abuts an extension 74 projecting forwardly from the flat section of the housing cover 28. The extension 74 includes a forked or recessed end 76 extending on opposite sides of the motor 16. The motor 16 is thus pushed forwardly, toward the massage head 24, by the extension 74.

It will be seen that removing the screws 40 from the assemblies 34, 36, 38 allows the housing cover 28 to separate from the main housing section 26. Because the motor 16 is not attached to the housing 12, it separates from the gear reducer 20 and drops out of the open end of the main housing section 26 when the housing cover 28 is removed.

As shown best in FIG. 2, the first partition wall 70 is a major chord of a circle having an upper edge 78 scalloped to partially receive the fastener assemblies 34. In the event there is any tendency of the partition wall 70 to twist in reaction to rotation of the motor 16 or gear reducer 20, the fastener assemblies 34 react against the upper edge 78 of the partition wall 70 and restrain it from twisting about an axis 80.

Several other features of the partition wall 70 are evident in FIG. 2. Extending forwardly of the wall 70, parallel to but spaced from the axis 80, are a plurality, preferably four, of elongate relatively rigid spacer members 82. As will be more fully apparent momentarily, the spacer members 82 abut or interfit with a forward gear plate 84 and prevent the partition wall 70 from approaching the gear plate 84. The partition wall 70 acts as part of the gear reducer 20 and provides a pair of bosses 86, 88 receiving one end of a pair of gear shafts 90, 92.

The gear reducer 20 comprises the forward gear plate 84 including a body or flange 94 of similar shape to the partition wall 70 having a scalloped upper edge 96 immediately below the fastener assemblies 34. The body 94 includes a central hub 98 extending into the cavity provided by the end cap 30 and having a passage 100 therethrough, a circular wall 102 closely received in the end wall opening 52 and sealed thereagainst by an O-ring 104. The body 94 also provides a pair of bosses 106, aligned with the bosses 86, 88 receiving the gear shafts 90, 92 and a recess (not shown) receiving one end of each of the spacer members 82. It will be seen that the extension 74 pushes the motor 16 forwardly, which pushes the partition wall 70 forwardly, which acts through the spacer members 82 to push the body 94 forwardly against the shoulder 54. The O-ring 104 prevents water from entering the housing 12 around the outside of the wall 102.

The gear reducer 20 includes the output gear 69 driving a first large gear 108 mounted on the shaft 92. The large gear 108 includes a small gear 110 on the end thereof driving a second large gear 112 mounted on the gear shaft 90. The large gear 112 includes a small gear 114 on the end thereof which drives a gear 116 rigid with the end of a shaft 118 extending through the passage 100. An O-ring 120 is received in an O-ring groove provided on the inner end of the passage 100 to prevent water from entering the housing 12 on the outside of the shaft 118.

The shaft 118 comprises the rotary input member to the rotary-to-reciprocating motion conversion device 22 mounted between the end cap 30 and the end wall 50. A hub 122 rigid with the shaft 118 provides an eccentrically located cam or projection 124 extending into an elongate linear slot 126 provided by an eccentric 128 which moves up and down, in the direction of the arrow 130, as constrained by a pair of rails 132 comprising part of the end cap 30.

The eccentric 128 is of complex shape and is shown best by a comparison of FIGS. 1 and 3. The eccentric 128 includes a body 134 having a stub 136 extending along the axis thereof. A blind threaded passage 138 in the stub 136 receives a threaded bolt 140 cast into the massage head 24. The massage head 24 is accordingly rigid with the eccentric 128 and moves therewith. The body 134 includes a pair of parallel vertical walls 142 which slide on the rails 132 and thus control the direction of movement of the eccentric 128 and brush 24. The slot 126 is provided on the back of the body 134 and is perpendicular to the walls 142. The edges 144, 146 of the eccentric 128 are arcuate to avoid interference with the peripheral wall 58 of the end cap 30 thereby allowing maximum vertical oscillating movement of the eccentric 128.

The massage head 24 is of molded organic resin and includes a central hub 148 in which the bolt 140 is molded, a flange 150 generally perpendicular to the hub 148 and a multiplicity of fingers 152. The fingers 152 include an inner section 154 of a first cross-sectional area and an outer section 156 of smaller cross-sectional area. The outer sections 156 are accordingly more limber and give a preferred balance between flexibility and rigidity for the fingers 152.

An unusual aspect of this invention is that neither the motor 16 nor the gear reducer 20 is affixed to the housing 12. Instead, the motor 16 is secured to the first partition wall 70 and the gear reduction unit 20 is captivated between the first partition wall 70 and the forward gear plate 84, neither of which are rigidly secured to the housing 12. Thus, the partition wall 70 divides the main housing section 26 into compartments and is not rigidly attached to the main housing section 26. The motor 16 is pushed toward the front of the device 10 by the extension 74. Any adjustment because of mistolerance of parts is automatically accommodated by the axial play in the gears 69, 108.

Figure 4:
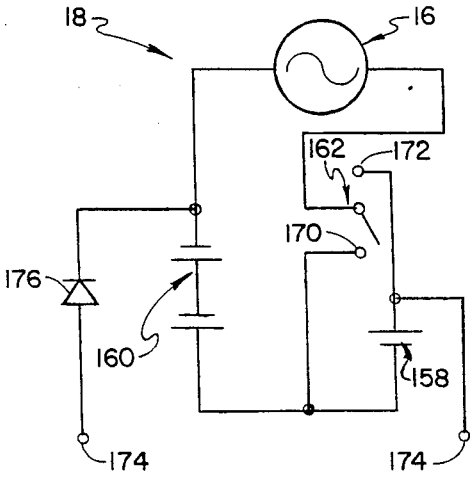
FIG. 4 is a schematic drawing of the electrical circuit of this invention.

As shown in FIGS. 1 and 4, the electric circuit 18 comprises first and second rechargeable batteries 158, 160 located in the pistol grip handle 32, a three position switch 162 having a housing 164 carried by a flat section 166 of the housing cover 28 and a switch actuator 168 located in a position easily reached by the thumb of the user. The motor 16 is of a type in which the output speed is a function of the voltage applied to the coils thereof and is capable of two speed operation. The battery 160 is of sufficient capacity to drive the motor 16 at a low speed when the switch 162 is closed against a terminal 170. When higher speed operation is desired, the switch 162 is manipulated to close against a terminal 172 to incorporate the battery 158 in the motor circuit.

Figure 5:
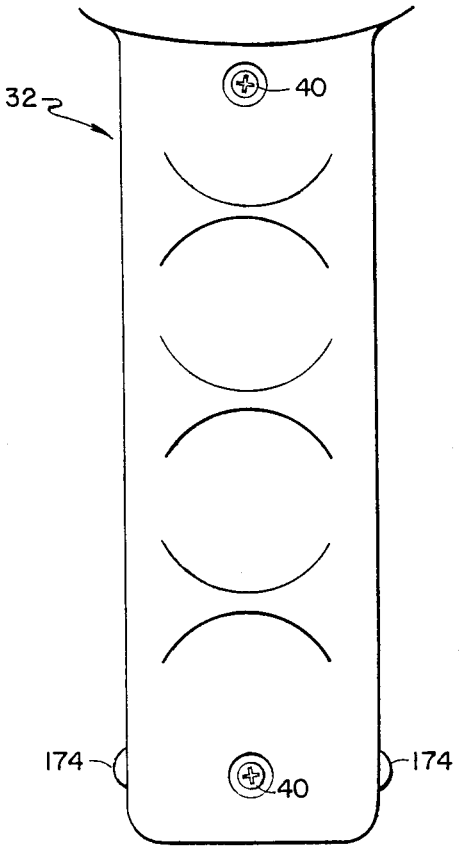
FIG. 5 is a partial front view of the pistol grip handle showing the recharging terminals.

Recharging of the batteries 158, 160 is accomplished through a pair of terminals 174 exposed through the base of the handle 32 in a conventional manner, as shown in FIG. 5. A light emitting diode 176 controls the direction of current flow to the batteries 158, 160 and is exposed through an opening 178 in the housing cover 28 to indicate when the batteries are being charged. The diode 176 is held in its opening 178 in the assembled condition of the device 10 by a rib 180 which extends along the center line of the main housing section 26. The rib 180 pushes a flange 182 of the diode 176 into engagement with a boss 184 provided by the housing cover 28.

Operation of the device 10 of this invention should now be apparent. When not in use, the device 10 is placed in a conventional battery charging stand (not shown) so the batteries 158, 160 are more-or-less continuously charged. When in use, the user depresses on the switch 162 to drive the motor 16 at one of its desired speeds. Driving of the motor 16 causes rotation of the output gear 69 thereby driving the gear reducer 20 and rotating the shaft 118. Rotation of the shaft 118 causes the cam or projection 124 to revolve about the axis 80. Revolution of the cam 124 causes the eccentric 128 to move up and down, as constrained by the rails 132. The vertical component of movement of the cam 124 effectively causes oscillation of the eccentric 128 while the horizontal component of movement of the cam 124 is effectively eliminated because the cam 124 merely rides back and forth in the slot 126. Oscillation of the eccentric 128 causes the massage head 24 to oscillate in the same direction, i.e. in a vertical plane intersecting the mid-line of the main housing section 26 and pistol grip handle 32. It will be apparent that the housing 12 is waterproof, i.e. sealed against the entry of water from outside, by the O-ring seals 42, 47, 104, 120. Even if the seals fail, entry of water into the housing 12 is only aggravating but not dangerous because the potential of the batteries 158, 160 is insufficient to cause injury.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A shampoo or massage device comprising a housing having a pistol grip handle providing a first cavity and a generally cylindrical section perpendicular to the pistol grip section including first and second spaced partition walls providing second, third and fourth cavities aligned along a housing axis;

rechargeable battery means in the first cavity and electrical conductor means communicating through the pistol grip section for recharging the battery means when the pistol grip section is placed in a battery charger;

a dc motor, in the second cavity, mounted on the first partition wall and including an output shaft extending through the first partition wall;

circuit means including a switch connecting the motor to the battery means;

a gear reduction unit, in the third cavity, having a rotary input member operatively connected to the motor output shaft, and a gear reduction output member;

a rotary to reciprocating conversion unit in the fourth cavity comprising a rotary input member extending across the second partition wall and operatively connected to the gear reduction output member and a reciprocating output member traversing a path of movement across the housing axis; and means sealing between the third and fourth cavities including means providing a seal between the second partition wall and the rotary input member; and a body engaging assembly mounted on the reciprocating output member having a plurality of body engaging members generally parallel to the housing axis.

2. The shampoo or massage device of claim 1 wherein the housing provides an end wall axially spaced from the first and second partition walls having first elongate slot therein, the rotary-to-reciprocating conversion device comprising an eccentric including a stub extending through the first slot and connected to the body engaging assembly, a slide rigid with the stub and constrained for linear movement in the housing and providing a second linear slot therein, and a cam received in the second slot and operatively connected to the rotary input member of the conversion device at a location eccentric relative thereto.

3. The shampoo or massage device of claim 2 wherein the rotary-to-reciprocating conversion device comprises a guide member on the housing end wall facing toward the second partition wall providing a pair of parallel guiding surfaces and a guided member fixed to the slide and disposed between the parallel guiding surfaces, the guided member having parallel guiding faces engaging the guiding surfaces.

4. The shampoo or massage device of claim 1 wherein the housing comprises a main housing section providing the cylindrical section and part of the pistol grip handle and a housing cover providing part of the pistol grip handle, the main housing section and housing cover meeting along a junction and further comprising an O-ring seal between the main housing section and housing cover at the junction for sealing therebetween.

5. The shampoo or massage device of claim 4 further comprising a plurality of threaded fasteners having a head securing the main housing section to the housing cover and means sealing the threaded fasteners against the housing including an O-ring seal captivated between the threaded fastener head and the housing.

6. The shampoo or massage device of claim 1 wherein the second partition provides an enlarged opening therethrough and the means providing a seal between the third and fourth cavities includes a gear plate having a central hub providing a passage therethrough receiving the rotary input member of the rotary to reciprocating conversion unit, an O-ring seal sealing between the hub passage and the conversion unit rotary input member, a flange extending away from the central hub and a circular wall extending into the second partition opening, and an O-ring seal between the second partition wall and the flange.

7. The shampoo or massage device of claim 6 wherein the motor output shaft has a gear thereon and the gear reduction unit comprises a first shaft having a first gear rotatable thereon in meshing engagement with the motor output shaft gear, a second shaft having a second gear rotatable thereon in meshing engagement with the first gear, the first and second partition walls providing aligned sets of recesses receiving the first and second shafts.

8. The shampoo or massage device of claim 1 wherein the housing comprises a main housing section and a housing cover separable along a parting plane passing through the pistol grip, and the first partition wall is loosely received in the cylindrical housing section, and further comprising means captivating the motor including an extension carried by the housing cover, extending along the housing axis into engagement with the motor, and pushing the motor toward the gear reduction unit.

* * * * *